United States Patent [19]

Oiler

[11] 4,114,879

[45] Sep. 19, 1978

[54] GOLD PUTTING CUP AND FLAGSTICK HOLDING ASSEMBLY

[75] Inventor: Willard E. Oiler, Winter Haven, Fla.

[73] Assignee: Menasha Corporation, Neenah, Wis.

[21] Appl. No.: 729,490

[22] Filed: Oct. 4, 1976

[51] Int. Cl.[2] ..... A63B 57/00

[52] U.S. Cl. ..... 273/34 R; 248/524; 248/511; 116/173

[58] Field of Search ..... 273/34 R, 34 A, 34 B; 116/173, 174, 175; 248/524, 511, 539, DIG. 7

[56] References Cited

U.S. PATENT DOCUMENTS

| | | | |
|---|---|---|---|
| 1,676,954 | 7/1928 | Kannemann | 273/34 R |
| 1,744,985 | 1/1930 | Picha | 273/34 R |
| 3,204,599 | 9/1965 | Milosch | 273/34 R X |
| 3,225,734 | 12/1965 | Bule | 116/173 |
| 3,348,797 | 10/1967 | Turbyfill | 273/34 R X |

*Primary Examiner*—George J. Marlo

*Attorney, Agent, or Firm*—Andrus, Sceales, Starke & Sawall

[57] ABSTRACT

A ferrule construction for a golf flagstick. The ferrule is secured to the lower end of the flagstick and is adapted to be engaged with the bore in the cup that is set in the golf green. The ferrule includes an upper beveled surface which engages a complementary beveled surface in the base of the cup bordering the bore, and a pair of circumferential rings or collars are located in spaced relation beneath the beveled surface. The double ring construction achieves an improved bracing effect against the wind, thereby maintaining the flagstick in a vertical attitude while providing adequate dirt and sand clearance between the ferrule and the bore.

3 Claims, 3 Drawing Figures

GOLD PUTTING CUP AND FLAGSTICK HOLDING ASSEMBLY

BACKGROUND OF THE INVENTION

A golf cup has a height of about 6 inches and is set in the golf green so that the upper edge is about 1 inch below the surface of the green. The base of the cup has a bore and a ferrule on the end of the flagstick is inserted in the bore to support the flatstick in the cup. There is insufficient clearance between the flagstick and the wall of the cup to permit the ball to fall into the cup with the flagstick in place.

It is important that the ferrule on the bottom of the flagstick fit in the bore in a manner so as to keep the flagstick in a precise vertical attitude. A sloppy fit between the ferrule and the bore in the cup creates a leaning condition for the flagstick which can block the ball from going into the cup.

A further requirement is that the flagstick must be firmly held in place in the cup under high wind conditions, yet there must be sufficient clearance between the ferrule and the bore to prevent the pin from being jammed in the bore while providing the necessary sand and dirt clearance.

SUMMARY OF THE INVENTION

The invention is directed to a ferrule construction for a golf flagstick which will maintain the flagstick in a vertical position in high winds and yet will provide sufficient clearance for sand and dirt.

In accordance with the invention, the flagstick ferrule is provided with an upper beveled surface which engages a complimentary beveled surface bordering the bore in the cup. Located beneath the beveled surface are a pair of vertically spaced circumferential rings or collars which are adapted to fit within the bore in the cup.

The pair of rings function as anchors by providing a bracing effect to maintain the flagstick in a vertical attitude. The upper ring anchors the flagstick on the leeward side while the bottom ring anchors the stick on the windward side, thus bracing the entire assembly against wind and preventing deflection of the lower end of the flagstick and maintaining the desired clearance between the flagstick and the cup wall.

As a further advantage, the dual ring construction creates a wiping action within the bore in the cup, causing sand or dirt to be pushed downward when the ferrule is introduced into the bore and pulling sand and dirt upwardly when the flagstick is withdrawn.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
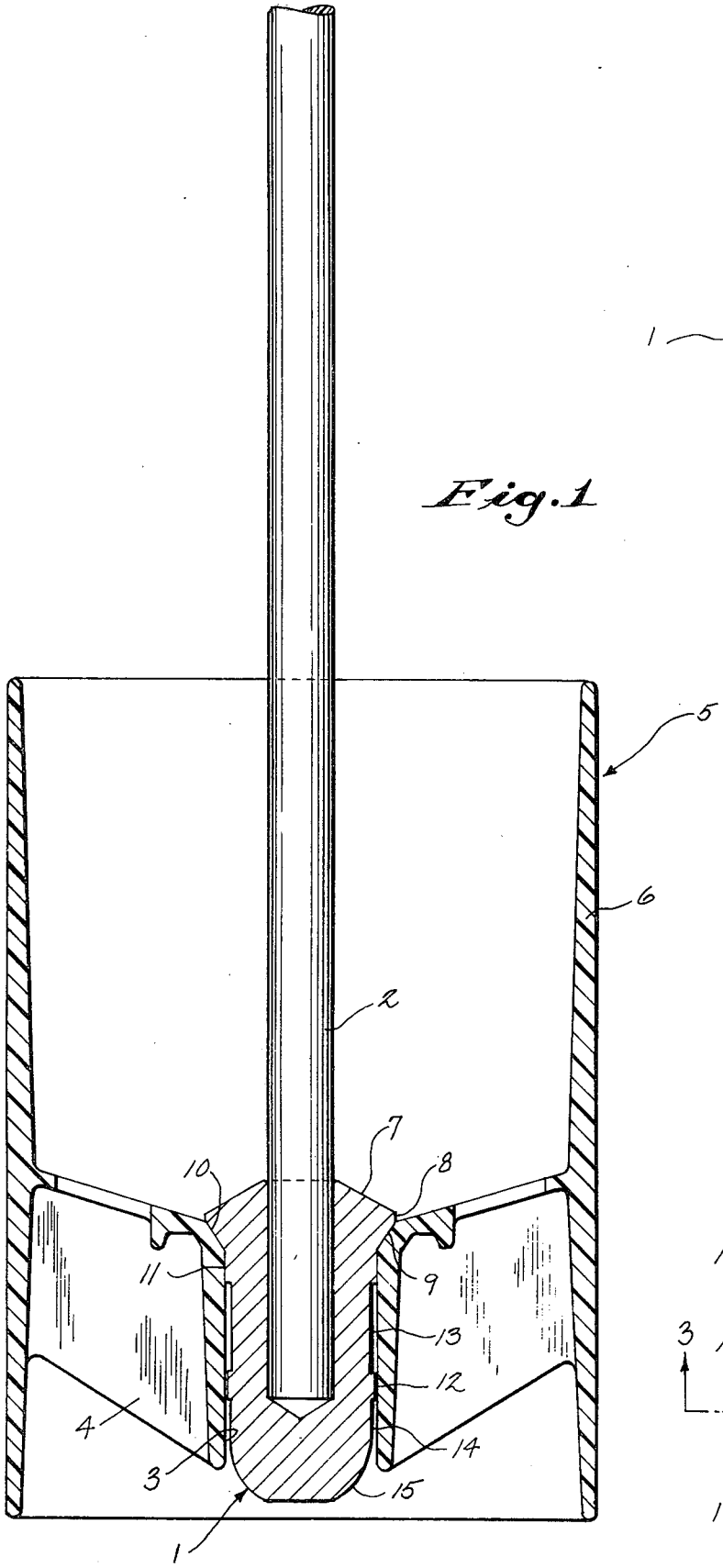
FIG. 1 is a vertical section showing the ferrule construction of the invention with the flagstick engaged with the cup.
Figure 3:
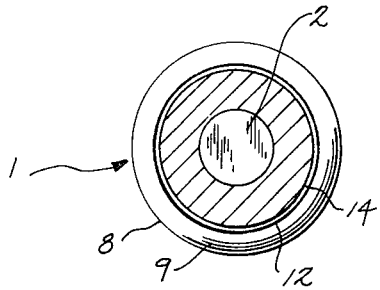
FIG. 3 is a section taken along line 3—3 of FIG. 2.

As shown in the drawings, a ferrule 1 is secured to the lower end of a flagstick 2 and is adapted to be received within a central bore 3 in the spider base portion 4 of a cup 5 that is set in the green. The cylindrical side wall 6 of the cup is normally set in the green so that the upper edge of the wall 6 is about 1 inch below the surface of the green.

Figure 2:
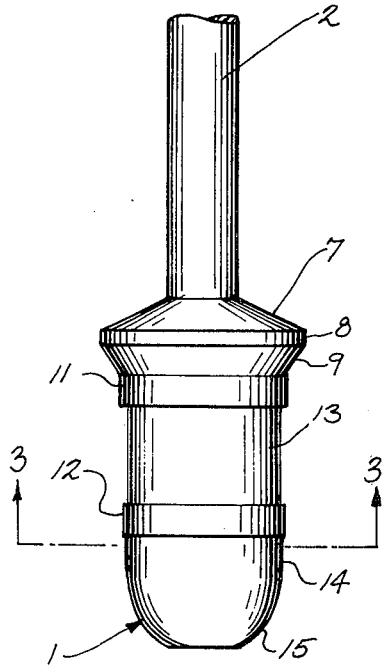
FIG. 2 is a side elevation of the ferrule.

As illustrated in FIG. 2, the ferrule is provided with an upper beveled surface 7 which terminates in a cylindrical or annular surface 8, and located beneath surface 8 in a beveled or downwardly and inwardly converging surface 9 which is adapted to engage the beveled surface 10 of the base 4 of the cup when the ferrule is inserted within the bore.

Located beneath the beveled surface is a pair of annular rings or collars 11 and 12 which are separated by a central cylindrical surface 13. A lower cylindrical surface 14 connects the lower ring 12 with the tapered end 15 of the ferrule.

The lower annular ring or collar 12 has a slightly smaller diameter than the upper ring 11, and the diameter of the lower cylindrical surface 14 is slightly greater than the diameter of the central surface 13.

In practice the diameter of the upper ring 11 is approximately 1.090 inches, while the diameter of the central surface 13 is 1.050 inches, thereby providing a 0.40 inch clearance for dirt and sand. The bottom ring has a diameter of 1.080 inches and this reduces the potential dirt and sand clearance from 0.040 to 0.010 inches in the area of the lower ring. Additional sand clearance is provided below the lower ring because the lower section 14 has a diameter of 1.060 inches.

The two-ring concept provides a strong bracing effect due to the two-point contact with the bore in the cup. Under wind conditions the upper ring anchors the ferrule and flagstick on the leeward side, while the bottom ring anchors the ferrule and flagstick on the windward side, thus bracing the flagstick against the wind and maintaining the flagstick in a vertical attitude, while providing sufficient clearance for the ball to enter the cup even under strong wind conditions. The construction also minimizes the possibility of the flagstick being forced out of the hole in heavy winds.

The two-ring construction also provides adequate clearance for sand and dirt and creates a wiping action within the bore in that the rings, and particularly the lower ring 12, pushes sand or dirt downward when the flagstick is inserted into the cup, while sand or dirt is pulled upwardly by the rings when the flagstick is withdrawn. Thus, the construction provides adequate clearance for sand and dirt and yet maintains a relatively close fit between the two rings and the internal surface of the bore in the cup.

Various modes of carrying out the invention are contemplated as being within the scope of the following claims particularly pointing out and distinctly claiming the subject matter which is regarded as the invention.

I claim:

1. In combination, a cup to be set into a golf green and having an outer cylindrical wall and a base, said base having a cylindrical central bore and an upwardly and outwardly diverging beveled surface at the upper end of the central bore, and a flagstick assembly including a flagstick and a one-piece ferrule secured to the lower end of the flagstick and adapted to be received within the bore, said ferrule having a downwardly and inwardly converging beveled annular surface disposed in mating engagement with the beveled surface at the upper end of the bore, said ferrule also having an upper annular collar located beneath said beveled annular surface and having a lower annular collar spaced vertically beneath said upper collar, said collars having generally cylindrical outer surface with the outer surface of the upper collar disposed in engagement with the wall of the bore and the cylindrical surface of the lower collar being spaced radially inward of the wall of the bore, said ferrule also including a central cylindrical surface extending between said upper and lower collars, said first and second collars providing a bracing effect against the bore to maintain the flagstick in the vertical attitude under heavy wind conditions, said central cylindrical surface having a smaller diameter than said collars to provide a clearance between the central cylindrical surface and said wall of the bore for foreign material.

2. The combination of claim 1, wherein the lower end of said beveled surface on said ferrule is joined to the cylindrical outer surface of the upper collar.

3. The combination of claim 1, wherein said ferrule has a lower cylindrical surface disposed beneath said lower collar, said lower cylindrical surface having a greater diameter than the central cylindrical surface and said lower cylindrical surface having a lesser diameter than the outer surfaces of said collars.

* * * * *

UNITED STATES PATENT AND TRADEMARK OFFICE

CERTIFICATE OF CORRECTION

PATENT NO. : 4,114,879

DATED : September 19, 1978

INVENTOR(S) : WILLARD E, OILER

It is certified that error appears in the above-identified patent and that said Letters Patent are hereby corrected as shown below:

In The Title: Cancel "GOLD" and substitute therefor ---GOLF---

Signed and Sealed this

*Sixth* Day of *February 1979*

[SEAL]

*Attest:*

RUTH C. MASON
*Attesting Officer*

DONALD W. BANNER
*Commissioner of Patents and Trademarks*